US009434392B2

(12) United States Patent
Hirashima et al.

(10) Patent No.: US 9,434,392 B2
(45) Date of Patent: Sep. 6, 2016

(54) COLLISION ENERGY ABSORPTION COLUMN AND RAILROAD VEHICLE PROVIDED WITH THE COLLISION ENERGY ABSORPTION COLUMN

(71) Applicant: KAWASAKI JUKOGYO KABUSHIKI KAISHA, Kobe-shi, Hyogo (JP)

(72) Inventors: Toshiyuki Hirashima, Kobe (JP); Seiichi Hayashi, Oshima-gun (JP); Hitoshi Nagahara, Akashi (JP)

(73) Assignee: KAWASAKI JUKOGYO KABUSHIKI KAISHA, Kobe-Shi (JP)

( * ) Notice: Subject to any disclaimer, the term of this patent is extended or adjusted under 35 U.S.C. 154(b) by 214 days.

(21) Appl. No.: 14/351,680

(22) PCT Filed: Jun. 12, 2013

(86) PCT No.: PCT/JP2013/003681

§ 371 (c)(1),
(2) Date: Apr. 14, 2014

(87) PCT Pub. No.: WO2013/187059

PCT Pub. Date: Dec. 19, 2013

(65) Prior Publication Data

US 2014/0245922 A1 Sep. 4, 2014

(30) Foreign Application Priority Data

Jun. 13, 2012 (JP) ..... 2012-133890

(51) Int. Cl.
*B61D 17/06* (2006.01)
*B61D 45/00* (2006.01)

(Continued)

(52) U.S. Cl.
CPC ..... *B61D 45/008* (2013.01); *B61D 15/06* (2013.01); *B61D 17/00* (2013.01); *B61D 17/04* (2013.01); *B61D 17/06* (2013.01)

(58) Field of Classification Search
CPC .... B61D 17/06; B61D 17/04; B61D 17/041; B61D 15/06; B61D 17/043; B61D 17/12; B61D 17/005; B61D 17/08; B61D 9/06; B61D 7/00; B61D 45/008; B61D 45/00; B61F 1/10
USPC ..... 105/402
See application file for complete search history.

(56) References Cited

U.S. PATENT DOCUMENTS 5,579,699 A * 12/1996 Dannawi ..... B60R 19/18 105/416

(Continued)

FOREIGN PATENT DOCUMENTS

EP 1 897 775 A1 3/2008
JP H07-217689 A 8/1995

(Continued)

OTHER PUBLICATIONS

Dec. 3, 2015 Office Action issued in Chinese Patent Application No. 201380013338.4.

(Continued)

*Primary Examiner* — Mark Le
(74) *Attorney, Agent, or Firm* — Oliff PLC

(57) ABSTRACT

A collision energy absorption column is provided on an end side of a railroad vehicle structure and extends from an end beam toward a roof structure. The collision energy absorption column includes a metal outer member having a transverse cross section of a channel shape, and an inner member made of reinforced plastic provided along an inner circumference of the outer member and extending in parallel with the outer member. The outer member is configured by joining two column halves extending along a column axis after arranging the two column halves are arranged in a direction perpendicular to the column axis of the outer member. The joined part of the column halves extends along the column axis. The outer member is coupled to the end beam and roof by a fastener. The inner member extends between the end beam and a part of the roof structure, excluding the fastening parts.

15 Claims, 10 Drawing Sheets

(51) Int. Cl.

| | |
|---|---|
| ***B61D 17/04*** | (2006.01) |
| ***B61D 15/06*** | (2006.01) |
| ***B61D 17/00*** | (2006.01) |

(56) References Cited

U.S. PATENT DOCUMENTS

| | | | | |
|---|---|---|---|---|
| 6,696,164 | B2 * | 2/2004 | Clifford | B32B 15/04 428/137 |
| 7,743,714 | B2 * | 6/2010 | Nedelik | B61D 17/06 105/392.5 |
| 2005/0052054 | A1 | 3/2005 | Hess et al. | |
| 2011/0135488 | A1 * | 6/2011 | Grove-Nielsen | B29C 70/025 416/241 A |

FOREIGN PATENT DOCUMENTS

| | | | |
|---|---|---|---|
| JP | A-11-173356 | | 6/1999 |
| JP | 2000 64505 | * | 2/2000 |
| JP | 2005170082 | A | 6/2005 |
| JP | 2006-282099 | A | 10/2006 |
| JP | A-2008-062817 | | 3/2008 |
| JP | 2010-241373 | A | 10/2010 |
| JP | 2011-235733 | A | 11/2011 |
| KR | 83-0000306 | Y1 | 3/1983 |

OTHER PUBLICATIONS

Sep. 17, 2013 International Search Report issued in International Application No. PCT/JP2013/003681 (with translation).
May 18, 2015 Search Report issued in European Patent Applicatin No. 13804230.4.

* cited by examiner

COLLISION ENERGY ABSORPTION COLUMN AND RAILROAD VEHICLE PROVIDED WITH THE COLLISION ENERGY ABSORPTION COLUMN

TECHNICAL FIELD

The present invention relates to a collision energy absorption column and a railroad vehicle provided with the collision energy absorption column which is provided in a leading-end vehicle of railroad vehicles.

BACKGROUND ART

Conventionally, as for railroad vehicles, in order to protect crews and passengers from a collision with an automobile, another railroad vehicle or the like, various structures for absorbing energy due to the collision has been proposed. For example, in Patent Document 1, a rail vehicle provided with a reinforcement member extending vertically in a vehicle end, and a bone member extending in a vehicle longitudinal direction is proposed. According to this structure, it absorbs energy by positively deforming when certain or greater load acts to the structure, the structure does not deform when less load acts to the structure.

REFERENCE DOCUMENT OF CONVENTION ART

Patent Document

[Patent Document 1] 22008-62817A

DISCLOSURE OF THE INVENTION

Problem(s) to be Solved by the Invention

Since each member of the conventional collision energy absorbing structure is made of metal, the structure is significantly heavy. Thus, this is one of the reasons of difficulties in reducing the entire weight of the railroad vehicle. Meanwhile, in order to protect the crews and passengers and to prevent each member from dropping out of its fitting part of the vehicle body, it is necessary to fully absorb the collision energy within a predetermined deflection amount. However, Patent Document 1 does not propose a railroad vehicle provided with a collision energy absorbing structure which satisfies the above-described two requirements. The purpose of the present invention is to provide a collision energy absorption column which can achieve both a weight reduction and sufficient collision energy absorption within the predetermined deflection amount.

SUMMARY OF THE INVENTION

A collision energy absorption column according to the present invention to be provided in an end part of a railroad vehicle and extend from an end beam toward a roof structure, comprising an outer member made of metal, the outer member having a channel shape or a hollow shape in a transverse cross section thereof, and an inner member made of reinforced plastic, the inner member being provided along an inner circumference of the outer member and extending in parallel with the outer member.

According to this configuration, since the inner member made of reinforced plastic does not directly contact a colliding object, the stress concentration immediately after the collision is small. That is, a crack generation after the collision can be delayed and larger collision energy can be accumulated. Then, when the collision energy is accumulated to a limit, the inner member will be eventually fractured, but at this point, the metal outer member still continues absorbing the collision energy, without being fractured. Thus, regardless of the column being partially made of resin, the large collision energy can be absorbed. In addition, the entire weight of the column can be reduced comparing with a case where the collision energy absorption column is entirely made of metal.

Further, by forming the transverse cross section of at least the outer member into a channel shape or a hollow shape, its section modulus becomes larger, compared with a case where the outer member is plate shape. Thus, since bending stress permitted becomes larger, the collision energy absorption column can receive a larger collision load, and can absorb larger collision energy.

Further, the outer member may be coupled to the end beam and the roof structure by a fastener, and the inner member may extend between an upper part of the end beam and a lower part of the roof structure, excluding the fastening part.

According to this configuration, since the collision energy absorption column is fastened with the end beam and the roof structure via the outer member made of metal, it does not need to fasten the inner member made of plastic with the end beam and the roof structure. Thus, since the inner member becomes easier to be deformed, with less restraints, larger collision energy can be absorbed until it is fractured. In addition, since it becomes unnecessary to extend the inner member up to the part which is fastened by the fastener, the cost can be reduced.

Further, the outer member may formed by joining two column halves extending along a column axis after the two column halves are arranged in a direction perpendicular to the column axis of the outer member, and a joined part of the column halves may extend along the column axis.

According to this configuration, the joined part of the column halves extends along the column axis. Thus, when the collision load is received from the direction perpendicular to the column axis, the joined part becomes difficult to be a starting point of a crack, compared with a case where the joined part is formed along the direction perpendicular to the column axis.

Further, each of the column halves may include a first plate part extending along the column axis, and second mutually parallel plate parts extending from both sides of the first plate part, perpendicular to the first plate part. Both the column halves may be arranged opposed to each other in a load direction of a collision load, and may be joined to each other at tip ends of the second plate parts. A plate face of the first plate part may face in a receiving direction of the collision load.

According to this configuration, since the two column halves are joined at the tip ends of the second plate parts, the position of the joint of both the column halves is located in the second plate part. The collision load is applied to the first plate part without the joined part. Thus, since the collision load is not directly applied to the joined part which tends to be a starting point of a fracture of the collision energy absorption column, easy fracturing can be prevented. Therefore, a collision energy absorption effect can be improved.

The reinforced plastic may be a plastic containing textiles and a volume content of the textiles may be 60% or more.

According to this configuration, since the textile content in the reinforced plastic is more than a predetermined amount, the intensity of the reinforced-plastic member against the collision load can be increased, and the resin column can be more difficult to be fractured.

EFFECT OF THE INVENTION

In the collision energy absorption column according to the present invention, both the weight reduction and the sufficient collision energy absorption within the predetermined deflection amount can be achieved.

BRIEF DESCRIPTION OF DRAWINGS

FIG. 4(*b*) is a graph illustrating the concept expected as a relation between the deformation stroke of the collision energy absorption column and the energy to be absorbed.

FIG. 8(*b*) is a view illustrating a modification of the cross-sectional shape.

MODE(S) FOR CARRYING OUT THE INVENTION

Hereinafter, a collision energy absorption column according to one embodiment of the present invention is described with reference to the drawings. Note that, below, the same referential numerals or symbols are assigned to the same or corresponding elements throughout the drawings and, thus, redundant description of the elements is omitted. The concept of directions in this embodiment is in agreement with the concept of directions when a traveling direction of a railroad vehicle is forward and one faces the front. That is, a vehicle longitudinal direction corresponds to a front-to-rear direction or a rear-to-front direction, and a vehicle width direction corresponds to a left-to-right direction or a right-to-left direction.

[Configuration of Railroad Vehicle Provided with Collision Energy Absorption Column]

Figure 1:
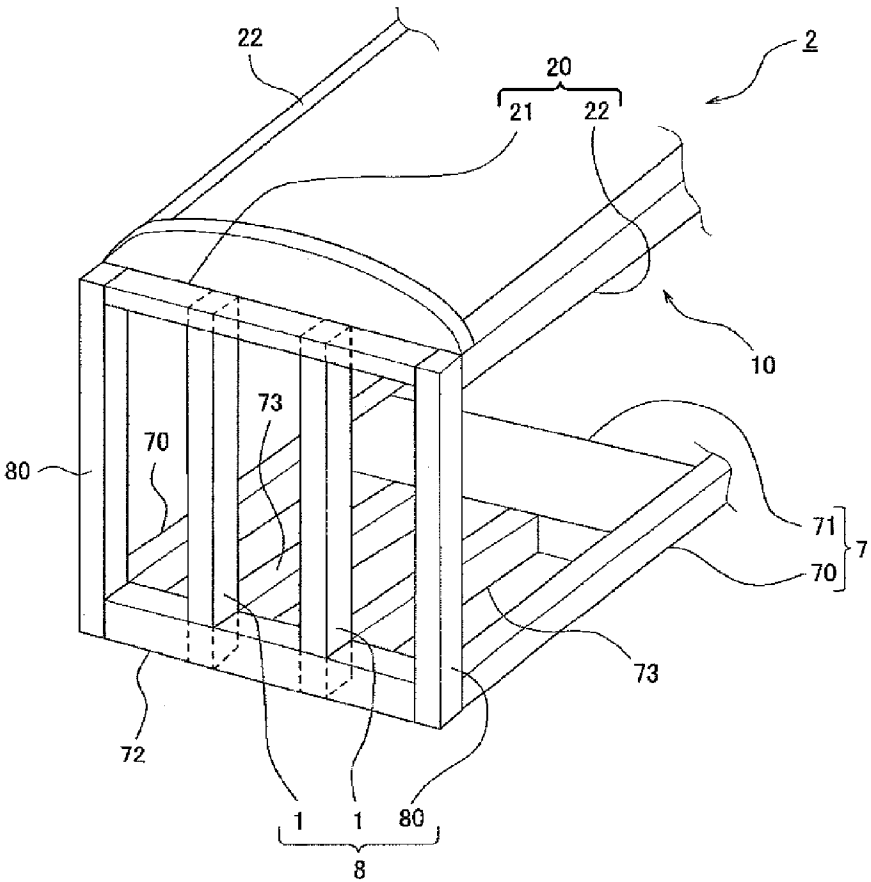
FIG. 1 is a perspective view illustrating a schematic structure of a railroad vehicle provided with collision energy absorption columns according to one embodiment of the present invention.

FIG. 1 is a perspective view illustrating a schematic structure of a railroad vehicle structure provided with collision energy absorption columns 1 according to the embodiment of the present invention. As is well known, a railroad vehicle structure 2 is provided with a side structural body 10 and an end frame body 8 on an underframe 7, and, for convenience of description, the end frame body 8 on the front side is illustrated. A roof structure 20 covers the side structural body 10 and the end frame body 8. The underframe 7 is provided with a pair of mutually-separated side sills 70 and a bolster beam 71 coupling rear end parts of the side sill 70. Front end parts between the side sills 70 are mutually coupled by an end beam 72. The end beam 72 and the above-described bolster beam 71 are coupled by two center sills 73 extending forward and rearward. The end frame body 8 is provided with a pair of corner posts 80 which stand on both sides of the end beam 72, and the two collision energy absorption columns 1 stood on the end beam 72 between these corner posts 80. The roof structure 20 is provided with an arch rail 21 which is located in a front end part thereof and extends in the vehicle width direction, and a cantrail 22 which extends rearwardly from both sides of the arch rail 21. Upper end parts of the corner post 80 and upper end parts of the collision energy absorption columns 1 are connected to the arch rail 21. That is, the collision energy absorption columns 1 are provided in an end part of the railroad vehicle structure 2, and extend toward the roof structure 20 from the end beam 72. The collision energy absorption columns 1 prevent from fracture and loss of the columns due to energy of a collision with an automobile or the like in a railroad crossing or a collision with another railroad vehicle while protecting crews and passengers, the energy being such that a bending deformation of the columns is within a predetermined amount at the time of the collision.

[Configuration of Collision Energy Absorption Column]

Figure 2:
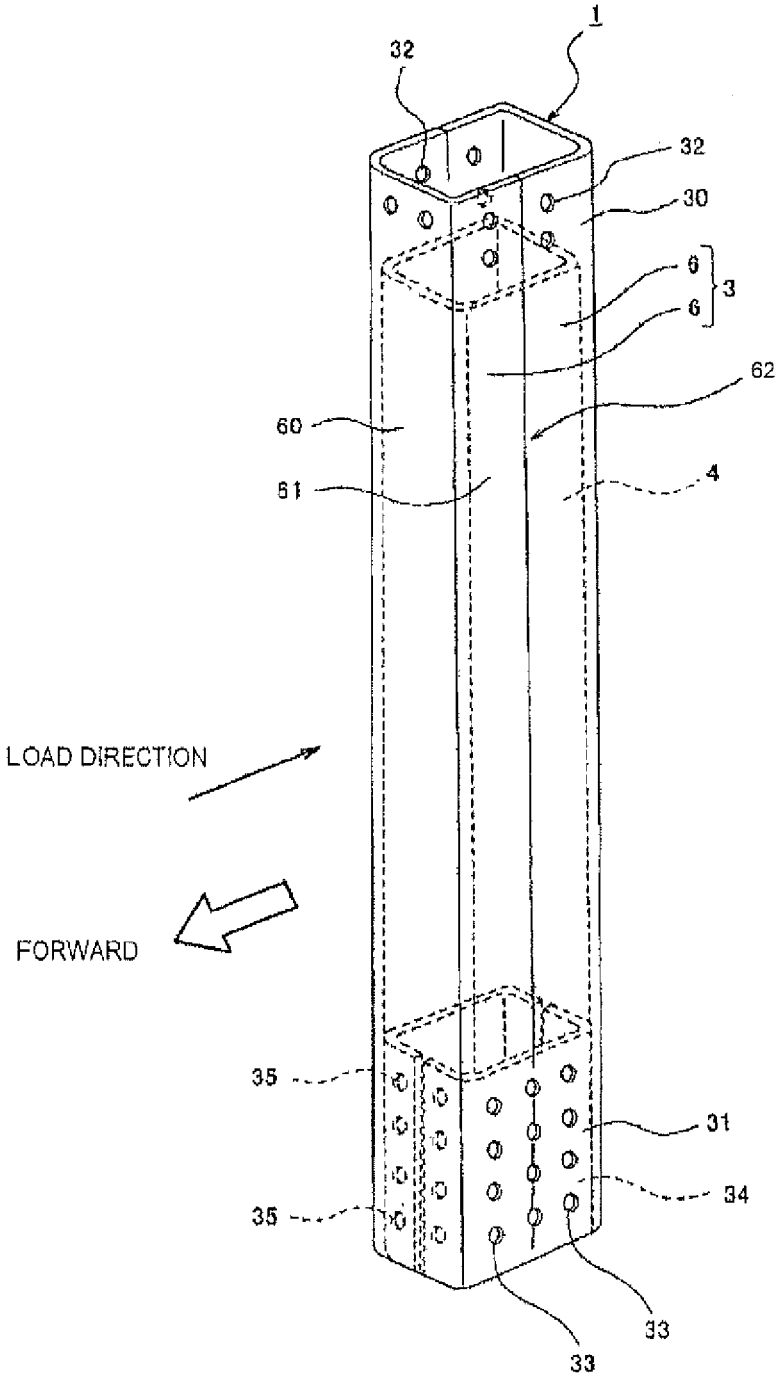
FIG. 2 is a perspective view of the collision energy absorption column according to the embodiment of the present invention.

FIG. 2 is a perspective view of the collision energy absorption column 1 according to this embodiment. This collision energy absorption column 1 is provided with a pillar-shaped outer member 3 made of metal which extends in the vertical direction, and a pillar-shaped inner member 4 made of reinforced plastic which extends in the vertical direction. Cross sections of both the outer member 3 and the inner member 4 are hollow and have rectangular shapes in their transverse cross sections, and the inner member 4 fits into the outer member 3 so that the outer circumferential surface of the inner member 4 conforms to the inner circumference of the outer member 3. The reinforced plastic which forms the inner member 4 is specifically carbon fiber reinforced plastic (CFRP) or glass fiber reinforced plastic (GFRP), which contains textiles. In this embodiment, a volume content of the textiles in CFRP or GFRP may be 60% or more. Note that the inner member 4 may be made of a material with a higher tensile strength in the column longitudinal direction, a less weight, and a smaller ductility than the outer member 3, any inner member 4 and any outer member 3 having similar characteristics may be applicable.

The inner member 4 is formed shorter in the vertical direction than the outer member 3. A first fastening area 30 and a second fastening area 31 where the inner member 4 does not exist are formed in an upper end part and a lower end part of the outer member 3, respectively. Within the first fastening area 30, a plurality of first through-holes 32 are formed in the outer member 3. Fasteners such as rivets or bolts are inserted into the first through-holes 32 to couple the arch rail 21 with the upper end of the collision energy absorption column 1. Further, a plurality of second through-holes 33 are formed in the outer member 3 within the second fastening area 31. Inside the second fastening area 31, a hollow reinforcing member 34 made of metal or reinforced plastic is provided. A plurality of through-holes 35 are formed in the circumference of the reinforcing member 34 so that the through-holes 35 are located in agreement with the second through-holes 33, respectively. Fasteners such as rivets or bolts are inserted into the second through-holes 33 and the through-holes 35 to couple the end beam 72 with the lower end part of the collision energy absorption column 1. The reason why the lower end part of the collision energy absorption column 1 is reinforced by the reinforcing member 34 is to prevent, when a collision load is applied centering on a lower part of the collision energy absorption column 1, the collision energy absorption column 1 from shearing or completely separating from the underframe.

As illustrated in FIG. 2, the outer member 3 is constructed so that two column halves 6 extending along the column axis are arranged in the front-to-rear direction. Each of the column halves 6 is provided with a first plate part 60 extending along the column axis, and a pair of second plate parts 61 which extend perpendicularly from both sides of the first plate part 60. Both the second plate parts 61 are parallel to each other. Both the columns halves 6 are oriented oppositely in the collision load direction (i.e., in the front-to-rear direction). Both the columns halves 6 are joined by welding at tip ends of the second plate parts 61, and this joined part forms a welding line 62 extending along the column axis. Plate faces of the first plate part 60 oppose from each other in a collision load receiving direction. Thus, when the railroad vehicle receives a collision load from the front, this collision load is received at the seamless first plate part 60. Therefore, when the collision energy absorption column 1 receives the collision load, fracturing caused from the joint is difficult to occur. Accordingly, the collision energy absorption column 1 can be prevented from fracturing easily, and a collision energy absorption effect can be improved.

In addition, the welding line 62 extends in the vertical direction. Thus, the welding line 62 is more difficult to become a starting point of the crack when the collision load is received from a direction perpendicular to the vertical direction, compared with a case where the welding line 62 is formed along the direction perpendicular to the vertical direction. Here, in order to reduce the entire weight of the railroad vehicle, the collision energy absorption column may be made of resin. However, such a resin material has small ductility. Therefore, the resin collision energy absorption column may have difficulties to absorb the energy by deforming plastically. That is, since the resin collision energy absorption column is fractured without greatly deforming plastically, the energy cannot fully be absorbed.

Alternatively, the collision energy absorption column may be made of resin and only necessary parts may be reinforced by metal to achieve the weight reduction. In this case, welding is typically used for joining the metal reinforcements. However, according to this collision energy absorption column, when the collision energy is applied, the collision energy absorption column becomes easy to fracture unstably from the welding joined part. Therefore, there may be a possibility that the collision energy cannot fully be absorbed as the collision energy absorption column. In addition, at the time of the collision, if the collision load is applied to a part where the reinforcements are not applied, there may also be a possibility that expected performances cannot be demonstrated. In the collision energy absorption column 1 of the embodiment, since it adopts a dual structure of the outer member 3 and the inner member 4 having the higher tensile strength in the column longitudinal direction, the lighter weight, and the smaller ductility than the outer member 3, both the weight reduction and the sufficient collision energy absorption can be achieved.

[Energy Absorption Effects]

Figure 3:
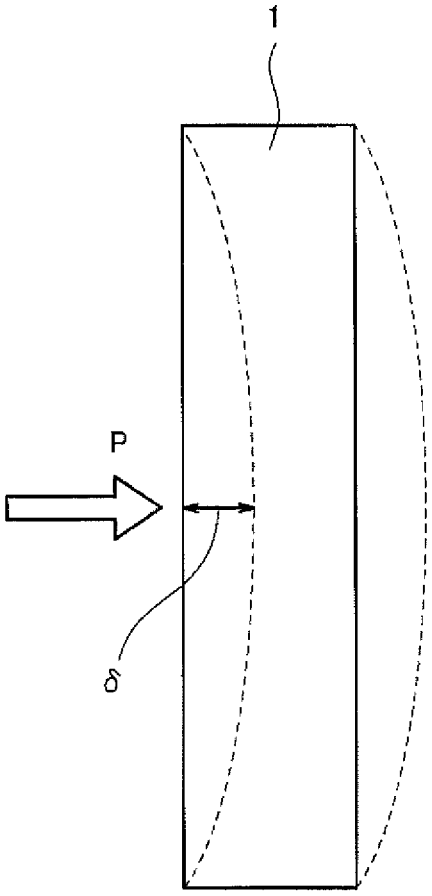
FIG. 3 is a view illustrating a deformation stroke when a collision load is applied to a central part in a column longitudinal direction of the collision energy absorption column.
Figure 4A:
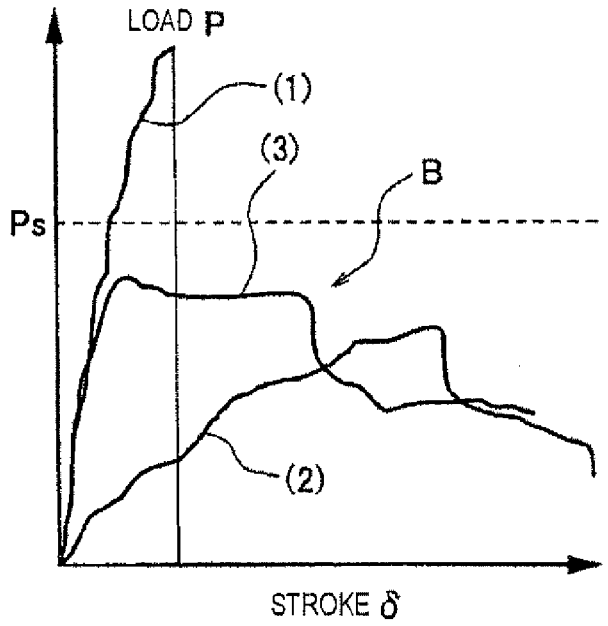
FIG. 4(*a*) is a graph illustrating the concept expected as a relation between the deformation stroke of the collision energy absorption column and a collision load which the collision energy absorption column receives (i.e., a reaction force)
Figure 4B:
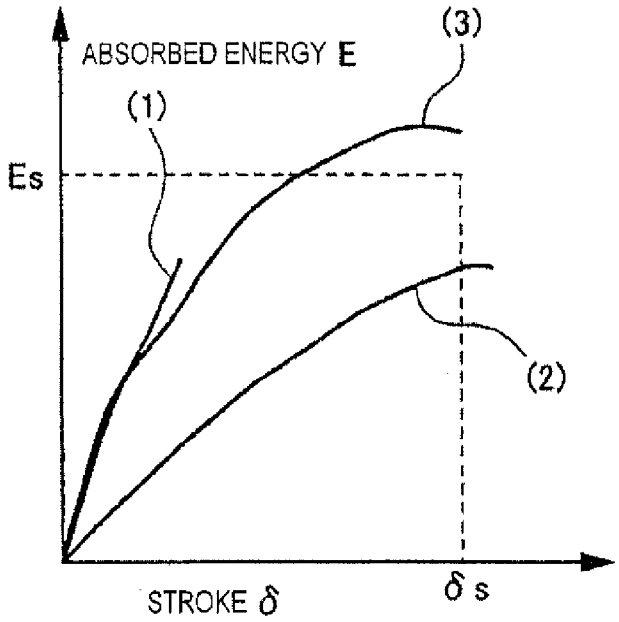

Next, in order to examine the energy absorption effect of the collision energy absorption column 1 of the embodiment, comparison results of a collision energy absorption column made only of reinforced plastic (hereinafter, simply referred to as "the reinforced-plastic collision energy absorption column"), a collision energy absorption column made only of metal (hereinafter, simply referred to as "the metal collision energy absorption column"), and the collision energy absorption column of this embodiment are described. Specifically, as illustrated in FIG. 3, a deformation stroke δ (deflection amount) when a collision load P is applied to a central part of the collision energy absorption column 1 in the column longitudinal direction is examined by comparisons. FIG. 4(*a*) is a graph illustrating a relation between the deformation stroke and the collision load which the collision energy absorption column receives (i.e., a reaction force), and FIG. 4(*b*) is a graph illustrating a relation between the deformation stroke of the collision energy absorption column 1 and the energy to be absorbed. In FIGS. 4 (*a*) and 4(*b*), a line (1) shows the reinforced-plastic collision energy absorption column, a line (2) shows the metal collision energy absorption column, and a line (3) shows the collision energy absorption column of this embodiment, respectively. The reinforced-plastic collision energy absorption column and the metal collision energy absorption column have the same mass. A load Ps refers to a limit load below which the joining part between the collision energy absorption column 1 and the underframe or the roof structure can sustain without fracturing. A stroke δs is a predetermined maximum bending which is permitted for the collision energy absorption column 1, and an absorbed energy Es is a predetermined collision energy to be absorbed by the collision energy absorption column 1.

The reinforced-plastic collision energy absorption column is comparatively lightweight even if it uses a thick plate, and as shown by the line (1), it can support a predetermined collision load with a short stroke. However, since the load Ps is reached while the stroke is short, the reinforced-plastic collision energy absorption column falls out of the vehicle structure before absorbing the predetermined collision energy. In addition, since the reinforced-plastic collision energy absorption column will not be deformed plastically, the effect to absorb the collision load is weak also in this regard. On the other hand, as shown by the line (2), the metal collision energy absorption column having the same mass as the reinforced-plastic collision energy absorption column of the line (1) plastically deforms by a comparatively small load. However, a load increase, i.e., an increasing rate of the energy to be absorbed is small as compared with a change in the stroke. Therefore, in order to absorb the predetermined collision energy Es with the stroke δs, it is necessary to construct the collision energy absorption column with a considerably thick plate which is difficult to be deformed plastically. However, the weight of the collision energy absorption column increases significantly.

As compared with the lines (1) and (2), as shown by a line (3), when the collision energy absorption column 1 of this embodiment receives the collision load, the metal outer member 3 begins a local plastic deformation at a comparatively early stage, but the reinforced-plastic inner member 4 fractures before the outer member does (at a point B in FIG. 4(*a*)). However, although the metal outer member 3 is plastically deformed, it is not yet fractured but continues absorbing the collision energy. Therefore, it is expected that greater collision energy can be absorbed per the same mass, compared with the collision energy absorption column which is entirely constructed from resin or metal. Thus, the collision energy absorption column of this embodiment can absorb sufficient collision energy within the predetermined deflection amount, while being reduced in weight. Further, by forming at least the outer member 3 to be hollow, a section modulus becomes large, as compared with a case where the outer member 3 has, for example, a flat plate shape. Accordingly, since the bending stress permitted becomes larger, a larger collision load can be received and larger collision energy can be absorbed. Further, for example, if the outer member 3 is made of reinforced plastic, the outer member 3 is immediately caused cracks to be fractured, when the collision energy absorption column 1 collides with a sharp obstacle. Thus, it becomes impossible to absorb the collision energy. However, since the outer member 3 is made of metal, the outer member 3 will not immediately be fractured even if the collision energy absorption column 1 collides with the sharp obstacle. Therefore, the collision energy can efficiently be absorbed.

(Analysis Result #1)

Figure 5:
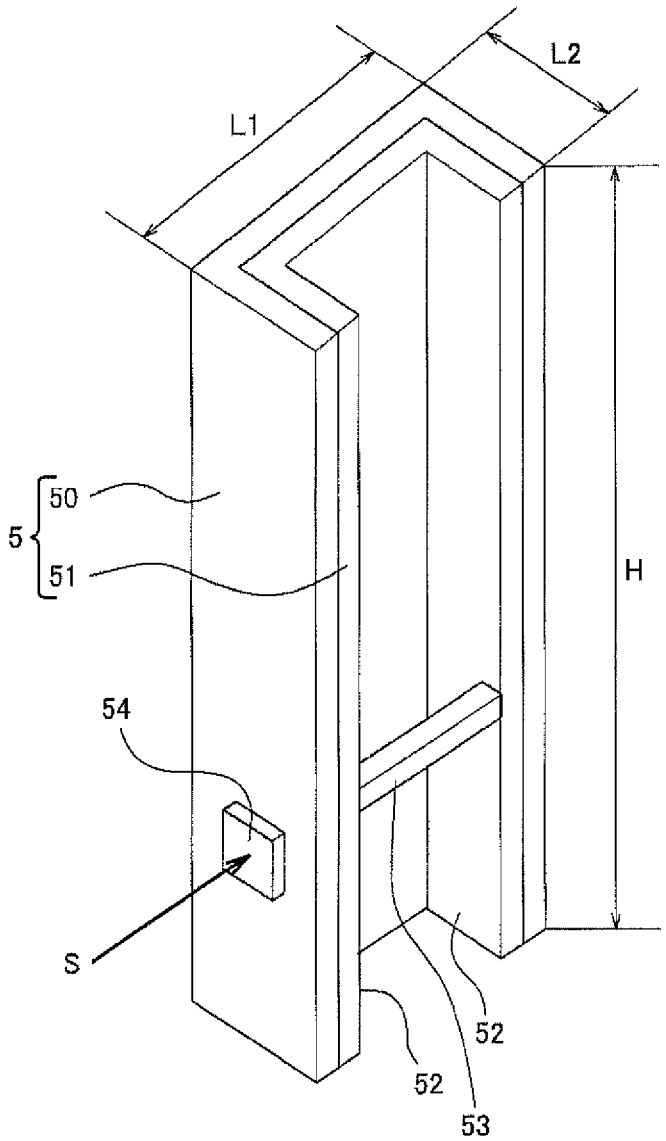
FIG. 5 is a perspective view of an analysis column.

In order to examine the above-described energy absorption effect, the applicant considered an analysis column 5 having a shape illustrated in FIG. 5. The analysis column 5 is provided with a first half 50 made of metal and a reinforced-plastic second half 51 having a channel cross section which is located inside the first half 50. Although not illustrated, an analysis column 5 having only the first half 50 was also considered. The first halves 50 are prepared, one having a thickness of 9 mm and another having a thickness of 11.7 mm. The thickness of the second half 51 is 20 mm. An analysis is conducted by simulations of a relation between a deformation stroke of the analysis column 5 and a load to be absorbed (i.e., a reaction force), and a relation between the deformation stroke and energy to be absorbed. The analysis column 5 illustrated in FIG. 5 has a depth L1 of 304.8 mm (12 inches), a width L2 of 152.4 mm (6 inches), and a height H of 2000 mm. It is assumed that, in a state where both ends of the analysis column 5 are fixed (restrained), a collision load is applied at a spot S thereof of 762 mm (30 inches) in height by a rectangular push member 54 at a speed of 400 mm/s. The second half 51 is provided with a pair of side walls 52 which oppose to each other, and a rib 53 is bridged between both the side walls 52 at the height of the spot S. Thus, both the side walls 52 are deformed similarly. In addition, the material of the first half 50 is stainless steel, and the material of the second half 51 is carbon fiber reinforced plastic (CFRP). Although the first half 50 and the second half 51 contact mutually but they are not adhered. A friction coefficient between both the halves 50 and 51 is 0.2. CFRP which is the material of the second half 51 is oriented so that a Unidirectional (UD) material runs in 0° direction, i.e., the direction of reinforced fiber is oriented in the longitudinal direction of the collision energy absorption column 1.

Upon the analysis, the analysis column 5 only having the 9-mm thickness first half 50 is called CASE1, the analysis column 5 only having the 11.7-mm thickness first half 50 is called CASE2, the analysis column 5 having the 9-mm thickness first half 50 and the 20-mm thickness second half 51 made of CFRP is called CASE3, and the analysis column 5 having the 9-mm thickness first half 50 and the 20-mm thickness second half 51 made of CFRP is called CASE3'. Note that the masses of the analysis columns 5 of CASE2, 3 and 3' are identical. As for CASE3' and CASE3, both ends of the second half 51 of the analysis column 5 are not restrained in CASE3', while both ends of the analysis column 5 are restrained in CASE3. Note that in CASE1 and CASE2, both ends of the second half 51 of the analysis column 5 are restrained. Material characteristics of CFRP which forms the second half 51, specifically, values of Young's modulus or modulus of elasticity E1 and E2, Poisson's ratio ν, shear coefficient $G_{12}$, tensile strength $N_{1t}$ and $N_{2t}$, compressive strength $N_{1C}$ and $N_{2C}$, and shear strength $S_{12}$ are as illustrated in Table 1.

TABLE 1

| | Young's modulus [GPa] | | Poisson's ratio | Shear coefficient |
|---|---|---|---|---|
| | $E_1$ | $E_2$ | ν | $G_{12}$ |
| CFRP | 125 | 8.89 | 0.331 | 4.69 |

| | Tensile strength [Mpa] | | Compressive strength [MPa] | | Shear strength |
|---|---|---|---|---|---|
| | $N_{1t}$ | $N_{2t}$ | $N_{1C}$ | $N_{2C}$ | $S_{12}$ |
| CFRP | 2196 | 67 | 1510 | 250 | 547 |

Here, as for subscripts 1 and 2 of the above symbols, the subscript 1 means that it is a value in the longitudinal direction of the analysis column 5, and the subscript 2 means that it is a value in a direction perpendicular to the longitudinal direction of the analysis column 5. In addition, CFRP which forms the second half 51 is an orthotropic material in consideration of breakage.

Figure 6:
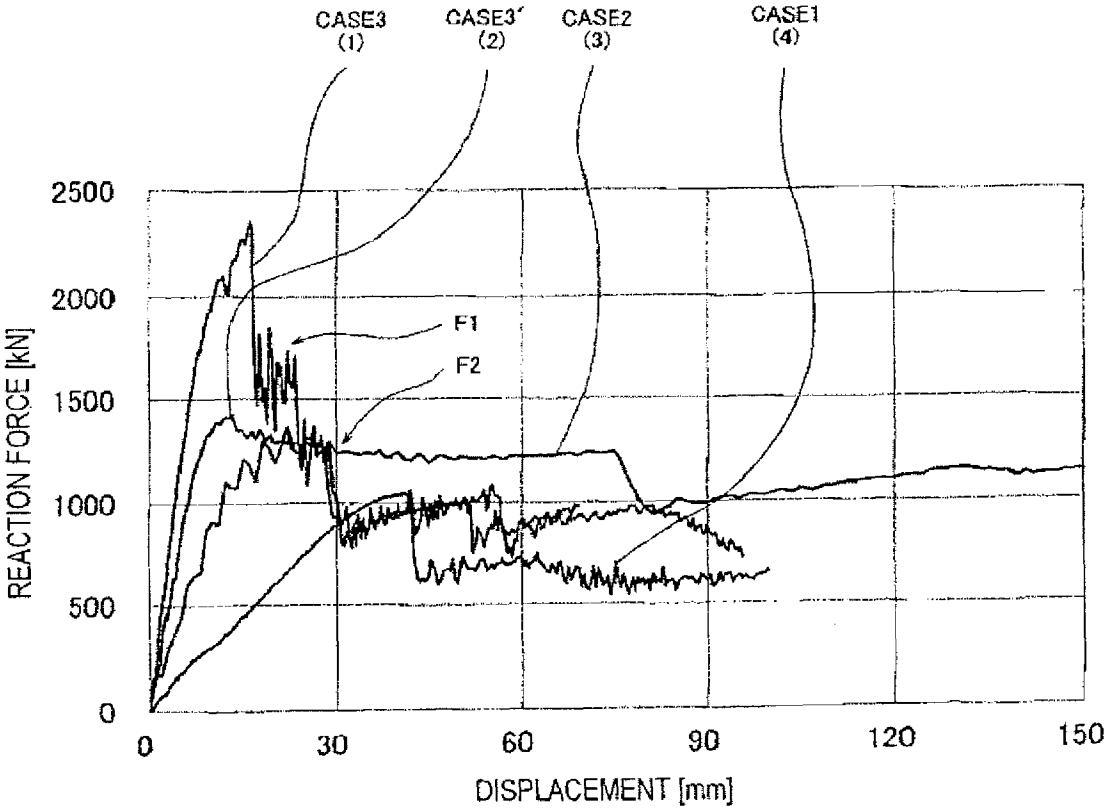
FIG. 6 is a graph illustrating the analysis result of a relation between the reaction force at the time of applying a collision load to the analysis column and a displacement thereof.
Figure 7:
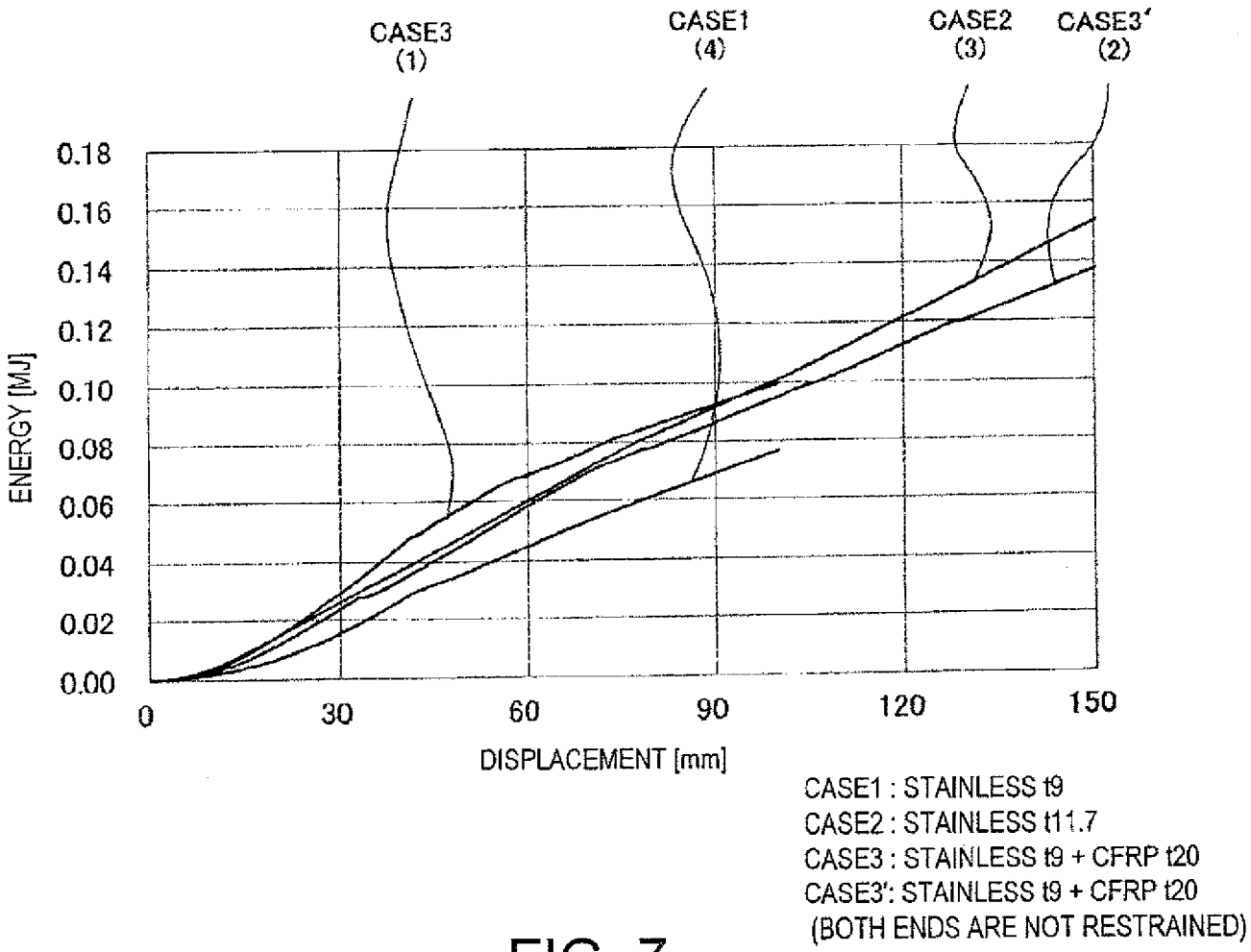
FIG. 7 is a graph illustrating the analysis result of a relation between an absorbed energy at the time of applying a collision load to the analysis column and a displacement thereof.

The analysis result of the relation between the reaction force and the displacement at the time of applying the collision load to the analysis column 5 is illustrated in the graph of FIG. 6, and the analysis result of the relation between the absorbed energy and the displacement is illustrated in FIG. 7, respectively. A unit of the displacement is mm, a unit of the reaction force is kN, and a unit of the energy is MJ.

In FIGS. 6 and 7, a line (1) is the analysis result of the analysis column 5 of CASE3 (9-mm thickness stainless steel+20-mm thickness CFRP, and both ends are restrained). A line (2) is the analysis result of the analysis column 5 of CASE3' (9-mm thickness stainless steel+20-mm thickness CFRP, and only the stainless steel part is not restrained at both ends). In addition, a line (3) is the analysis result of the analysis column 5 of CASE2 (11.7-mm thickness stainless steel only, and both ends are restrained), and a line (4) is the analysis result of the analysis column 5 of CASE1 (9-mm thickness stainless steel only, and both ends are restrained). In FIG. 7, and in FIGS. 10 and 12 which are described later, "t" indicates thickness. For example, 9 mm in thickness is indicated as "t9." As illustrated in FIG. 6, as compared with the line (4), when the collision energy absorption column 1 of the embodiment receives the collision load, the reinforced-plastic inner member 4 fractures first as illustrated in the lines (1) and (2) (points F1 and F2 in FIG. 6). However, the metal outer member 3 has not yet fractured, but continues absorbing the collision energy. Thus, it is proved that, as compared with the collision energy absorption column which is entirely made of resin, larger collision energy can be absorbed.

In addition, as illustrated in FIG. 7, it was found that, as comparing the line (4) with the line (3) (a comparison between CASE1 and CASE2), the plate thickness of the analysis column 5 must be thickened in order to absorb larger collision energy by the metal analysis column 5. However, as comparing the lines (1) and (2) with the line (3) (comparison of CASE3 and CASE3' with CASE2), the energy absorption with respect to the displacement is not much different between the analysis column 5 which combines the metal first half 50 and the reinforced-plastic second half 51, and the metal analysis column 5 with an increased thickness. Thus, it was found that, by having the dual-structured collision energy absorption column 1 of the metal outer member 3 and the reinforced-plastic inner member 4, the thickness of the outer member 3 can be made thinner while absorbing larger collision energy. In particular, in CASE3, the efficiency of the energy absorption is high, if the displacement is less than the predetermined amount (for example, up to about 90 mm).

(Analysis Result #2)

Figure 8A:
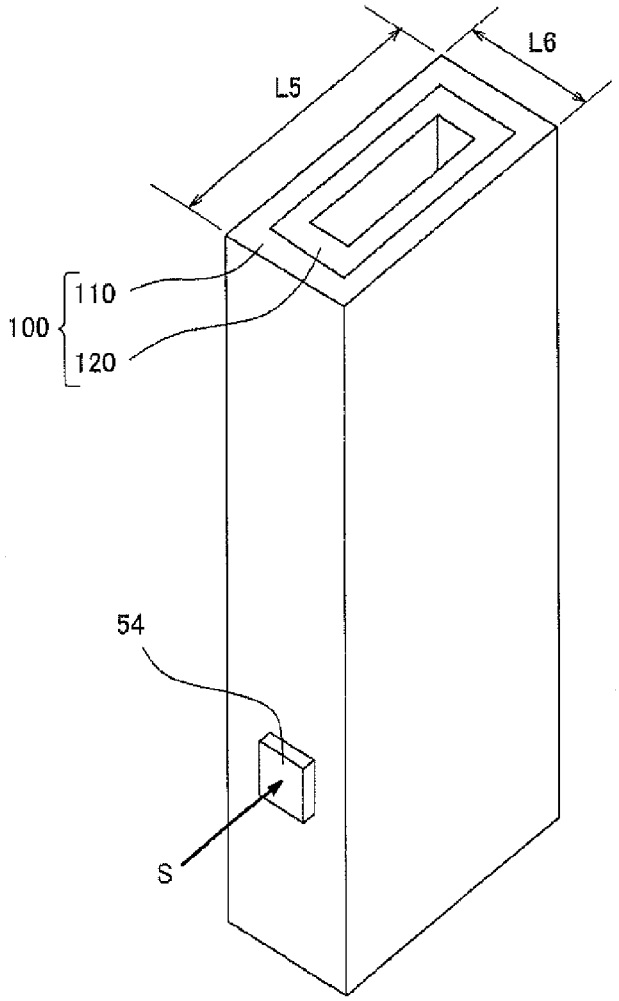
FIG. 8(*a*) is a perspective view of another analysis column.
Figure 8B:
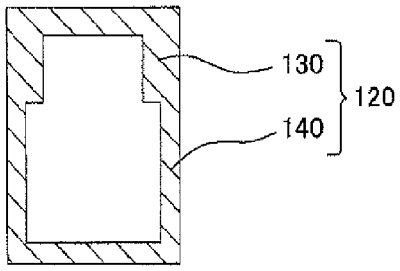

The applicant further considered an analysis column 100 illustrated in FIG. 8(*a*) in order to examine the energy absorption effect described above. The analysis column 100 has a depth L5 of 254 mm (10 inches), a width L6 of 152.4 mm (6 inches), and a height H of 2300 mm. It is assumed that a collision load is applied to a spot S of 762 mm (30 inches) in height by a rectangular push member 54 at a speed of 400 mm/s. The analysis column 100 is provided with a hollow outer rectangular column 110 having a rectangular cross-sectional shape, and a hollow inner rectangular column 120 having a rectangular cross-sectional shape of which an outer surface contacts an inner surface of the outer rectangular column 110. That is, unlike the analysis column 5 illustrated in FIG. 5, the cross-sectional shapes of the outer rectangular column 110 and the inner rectangular column 120 are closed. The outer rectangular column 110 is made of metal, such as stainless steel, and its thickness is 6 mm or 7.8 mm, and uniform all over the circumferences. The inner rectangular column 120 is made of CFRP, and its thickness is 10 mm, and uniform all over the circumferences. The applicant prepared the inner rectangular column 120, as illustrated in FIG. 8(*b*), having the cross-sectional shape provided with a first wall 130 of 16-mm thickness and a second wall 140 of 6-mm thickness which is continuously formed from the first wall 130. The outer rectangular column 110 and the inner rectangular column 120 are not adhered, and the friction coefficient between them is 0.2. Upon the analysis, the analysis column 100 only having the 6-mm thickness outer rectangular column 110 is called CASE1, the analysis column 100 only having the 7.8-mm thickness outer rectangular column 110 is called CASE2, the analysis column 100 having the 6-mm thickness outer rectangular column 110 and the 10-mm thickness inner rectangular column 120 made of CFRP is called CASE3, and the analysis column 100 having the 6-mm thickness outer rectangular column 110 and the inner rectangular column 120 having the cross-sectional shape illustrated in FIG. 8(*b*) is called CASE4. In any of CASE1 to CASE4, the analysis column 100 is restrained at both ends. The analysis columns 100 of CASE2, CASE3 and CASE4 are formed to have almost the same weight and, thus, this is to examine the energy absorption effects of the analysis columns 100 having the same weight.

Figure 9:
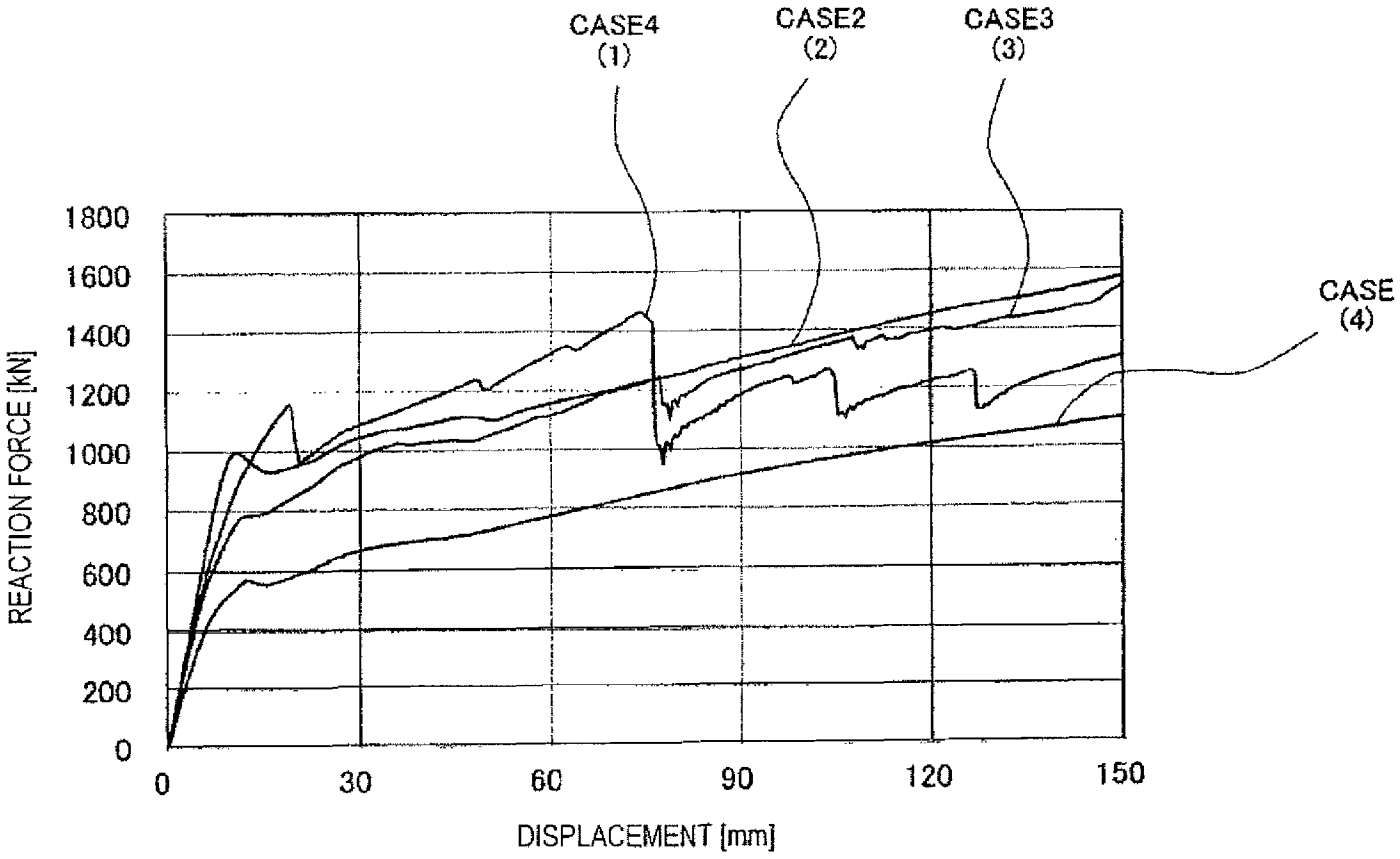
FIG. 9 is a graph illustrating the analysis results of a relation between a reaction force at the time of applying a collision load to the analysis column of FIG. 8 and a displacement.
Figure 10:
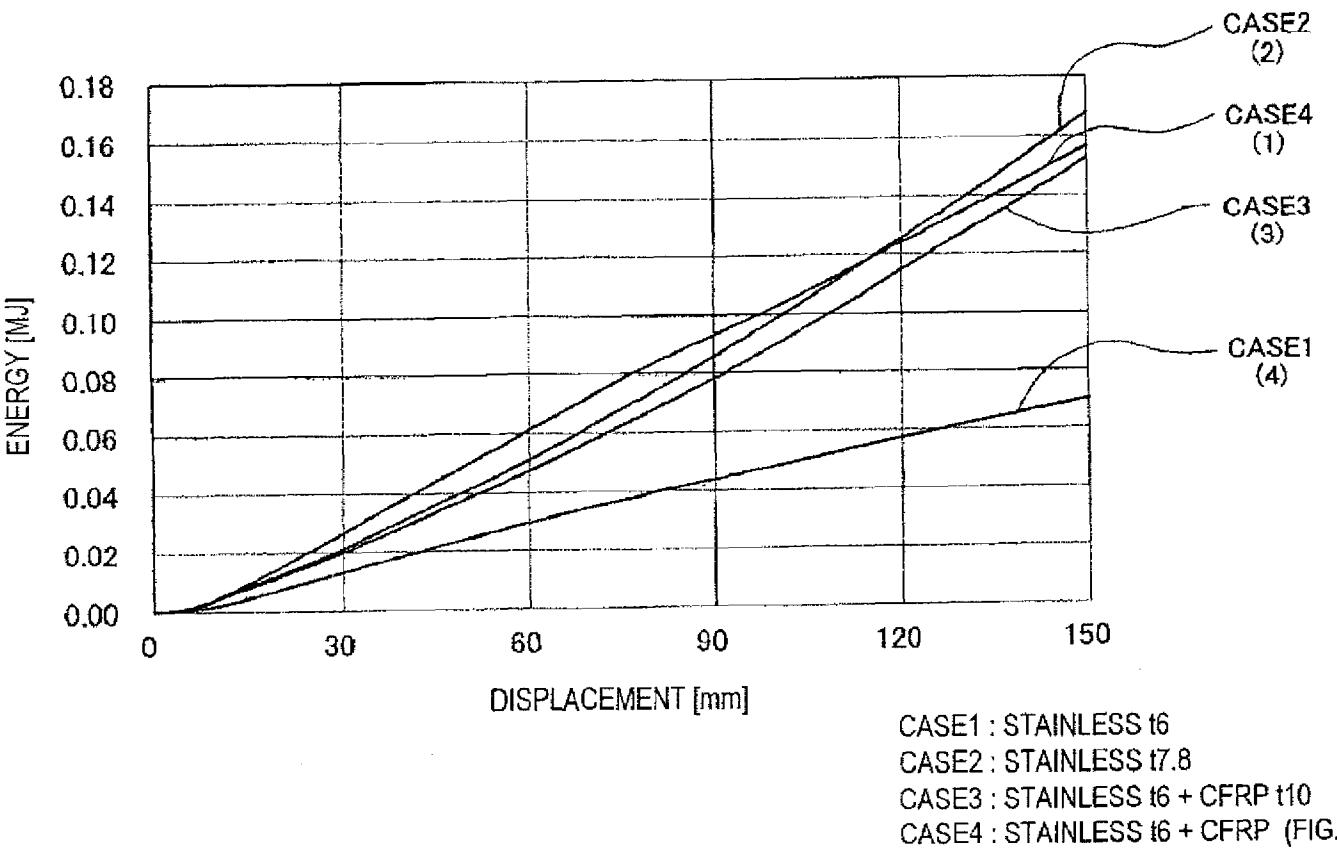
FIG. 10 is a graph illustrating the analysis result of a relation between the absorbed energy at the time of applying a collision load to the analysis column of FIG. 8 and a displacement thereof.

The analysis results of relations between a reaction force and a displacement at the time of applying a collision load to the analysis columns 100 are illustrated in a graph of FIG. 9, and the analysis results of relations between absorbed energy and the displacement are illustrated in FIG. 10, respectively. A unit of the displacement is mm, a unit of the reaction force is kN, and a unit of the energy is MJ. In FIGS. 9 and 10, a line (1) is the analysis result of the analysis column 100 of CASE4 (6-mm thickness stainless steel+CFRP illustrated in FIG. 8(*b*)), and a line (2) is the analysis result of the analysis column 100 of CASE2 (7.8-mm thickness stainless steel). In addition, a line (3) is the analysis result of the analysis column 100 of CASE3 (6-mm thickness stainless steel+10-mm thickness CFRP), and a line (4) is the analysis result of the analysis column 100 of CASE1 (6-mm thickness stainless steel only). According to the comparison between the line (4) and the line (3) illustrated in FIGS. 9 and 10 (the comparison between CASE1 and CASE3), respectively, even if the metal outer rectangular columns 110 of the same thickness are used, it was found that the amounts of energy absorption becomes about twice different within a range of the displacement from 90 to 150 mm between the analysis column 100 where the reinforced-plastic inner rectangular column 120 is inserted inside and the analysis column 100 were the inner rectangular column 120 is not inserted.

Further, the analysis column 100 of CASE4 according to the line (1) as illustrated in FIG. 10 excels in the energy absorption characteristics at or less than 110 mm in the displacement, as compared with the analysis columns 100 of CASE2 and CASE3 of the same weight (lines (2) and (3)). That is, the energy absorption performance improves by varying the thickness depending on the location in the circumferential direction of the inner rectangular column 120. However, when the displacement exceeds 110 mm, it can be considered that the fracture of the inner rectangular column 120 has started, and the energy absorption characteristic is slightly worse than the analysis column 100 of CASE2. Further, when the results of the analysis column 100 of CASE2 is compared with the analysis column 100 of CASE3 having the same weight corresponding to in FIGS. 9 and 10 (comparison of the line (2) and the line (3)), respectively, the effect that the analysis column 100 where the metal outer rectangular column 110 and the reinforced-plastic inner rectangular column 120 are combined particularly excels in the energy absorption characteristic than the analysis column 100 only using the metal outer rectangular column 110 cannot be acquired specifically when the displacement is large. However, according to CASE4, the effect is proved in that the collision energy absorption column 1 according to this embodiment absorbs sufficient collision energy, while reducing the weight with having less than the predetermined displacement.

Further, since the analysis column 100 where the metal outer rectangular column 110 and the reinforced-plastic inner rectangular column 120 are combined demonstrates the same or better energy absorption characteristics as/than the analysis column 100 only using the metal outer rectangular column 110, it was found that, by forming the collision energy absorption column 1 into the dual structure of the metal outer member 3 and the reinforced-plastic inner member 4, the thickness of the outer member 3 can be made thinner while absorbing larger collision energy. As described above, since the outer member 3 is formed by welding the two column halves 6, the welding of the column halves 6 becomes easier by forming each column half 6 thinner and, thus, a heat distortion at the time of welding both the columns halves 6 can be smaller. In the collision energy absorption column 1 of the above embodiment, both the outer member 3 and the inner member 4 are hollow in cross section. However, alternatively, both the cross sections of the outer member 3 and the inner member 4 may have channel shapes. Further, the cross sections may be, not limited to the rectangular shapes, any other various shapes, such as circular shapes or ellipses.

In the collision energy absorption column 1 of the above embodiment, although the outer member 3 is formed in a half body, it is not limited to this. For example, a hollow member made of an aluminum extruded material may also be used. Although the collision energy absorption column 1 of the above embodiment is linear, it may also be a column shape having a curvature. In the collision energy absorption column 1 of the above embodiment, the roof structure and the underframe are coupled by the fasteners, but they may also be coupled by welding or other ways. The outer member 3 and the inner member 4 may have the same length. In the above embodiment, although two collision energy absorption columns 1 are provided at the end of the railroad vehicle structure 2, one or three or more collision energy absorption columns 1 may also be provided. Further, the corner post 80 illustrated in FIG. 1 may instead be formed by the collision energy absorption column 1. Further, the reinforced plastic which forms the inner member 4 is not limited to CFRP or GFRP, but it may be other plastics, for example, KFRP (fiber-reinforced plastic containing Kevlar®) or BFRP (fiber-reinforced plastic containing boron). A number of improvements and other embodiments of the present invention are apparent from the above description for the person skilled in the art. Therefore, the above description is to be interpreted only as illustrations, and it is intended to teach the person skilled in the art one mode for carrying out the invention. The details of the structures and/or the functions may be altered substantially without departing from the scope of the invention.

INDUSTRIAL APPLICABILITY

The present invention is useful, when it is applied to a collision energy absorption column provided in a leading-end vehicle of railroad vehicles.

DESCRIPTION OF REFERENCE NUMERALS

1: Collision Energy Absorption Column
2: Railroad Vehicle Structure
3: Outer Member
4: Inner Member
5: Analysis Column
6: Column Half
50: First Half
51: Second Half
100: Analysis Column

What is claimed is:

1. A collision energy absorption column to be provided in an end part of a railroad vehicle and extend from an end beam toward a roof structure, comprising:

an outer member made of metal, the outer member having a channel shape or a hollow shape in a transverse cross section thereof; and an inner member made of reinforced plastic, the inner member being provided along an inner circumference of the outer member and extending in parallel with the outer member, wherein the outer member includes a first area to be coupled to the roof structure, and a second area to be coupled to the end beam, the first and second areas being end parts in a longitudinal direction of the column, the inner member is configured to extend between an upper part of the end beam and a lower part of the roof structure, excluding the first area and the second area, and the outer member at the first and second areas includes through holes, and the inner member has upper and lower ends terminated short of the first and the second areas.

2. The collision energy absorption column of claim 1, wherein the roof structure is to be coupled to the first area and the underframe is to be coupled to the second area, by a mechanical fastener, respectively.

3. The collision energy absorption column of claim 1, wherein the outer member is formed by joining two column halves extending along a column axis after the two column halves are arranged in a direction perpendicular to the column axis of the outer member, and a joined part of the column halves extends along the column axis.

4. The collision energy absorption column of claim 3, wherein each of the column halves includes a first plate part extending along the column axis, and second mutually parallel plate parts extending from both sides of the first plate part, perpendicular to the first plate part, and wherein both the column halves are arranged opposed to each other in a load direction of a collision load, and are joined to each other at tip ends of the second plate parts, and a plate face of the first plate part faces in a receiving direction of the collision load.

5. The collision energy absorption column of claim 1, wherein the reinforced plastic is a plastic containing textiles and a volume content of the textiles is 60% or more.

6. The collision energy absorption column of claim 1, wherein the reinforced plastic is FRP containing CFRP or GFRP.

7. A railroad vehicle comprising the collision energy absorption column of claim 1, the column being a collision post standing from a underframe.

8. The railroad vehicle further comprising a corner post standing between a side sill and an end beam, the corner post including the collision energy absorption column of claim 1.

9. A collision energy absorption column to be provided in an end part of a railroad vehicle and extend from an end beam toward a roof structure, comprising:

an outer member; and an inner member housed inside the outer member, the inner member having a higher tensile strength than a tensile strength of the outer member in a longitudinal direction of the column, and the inner member being lighter in weight and smaller in ductility than the outer member, wherein the outer member includes a first area to be coupled to the roof structure, and a second area to be coupled to the end beam, the first and second areas being end parts in a longitudinal direction of the column, the inner member is configured to extend between an upper part of the end beam and a lower part of the roof structure, excluding the first area and the second area, and the outer member at the first and second areas includes through holes, and the inner member has upper and lower ends terminated short of the first and the second areas.

10. The collision energy absorption column of claim 9, wherein the roof structure is to be coupled to the first area and the underframe is to be coupled to the second area, by a mechanical fastener, respectively.

11. The collision energy absorption column of claim 9, wherein the outer member is formed by joining two column halves extending along a column axis after the two column halves are arranged in a direction perpendicular to the column axis of the outer member, and a joined part of the column halves extends along the column axis.

12. The collision energy absorption column of claim 11, wherein each of the column halves includes a first plate part extending along the column axis, and second mutually parallel plate parts extending from both sides of the first plate part, perpendicular to the first plate part, and wherein both the column halves are arranged opposed to each other in a load direction of a collision load, and are joined to each other at tip ends of the second plate parts, and a plate face of the first plate part faces in a receiving direction of the collision load.

13. The collision energy absorption column of claim 9, wherein the reinforced plastic is a plastic containing textiles and a volume content of the textiles is 60% or more.

14. A railroad vehicle comprising the collision energy absorption column of claim 9, the column being a collision post standing from a underframe.

15. The railroad vehicle further comprising a corner post standing between a side sill and an end beam, the corner post including the collision energy absorption column of claim 9.

* * * * *